US009062922B1

(12) United States Patent
Burt et al.

(10) Patent No.: US 9,062,922 B1
(45) Date of Patent: Jun. 23, 2015

(54) REVOLVER CYLINDER FOR A SHOTGUN

(71) Applicants: Eric C. Burt, Brooklyn, NY (US); Caleb Clark Crye, Brooklyn, NY (US)

(72) Inventors: Eric C. Burt, Brooklyn, NY (US); Caleb Clark Crye, Brooklyn, NY (US)

(73) Assignee: LINEWEIGHT, LLC, Brooklyn, NY (US)

( * ) Notice: Subject to any disclaimer, the term of this patent is extended or adjusted under 35 U.S.C. 154(b) by 0 days.

(21) Appl. No.: 14/460,187

(22) Filed: Aug. 14, 2014

Related U.S. Application Data

(63) Continuation of application No. 14/150,994, filed on Jan. 9, 2014, now Pat. No. 8,839,709.

(51) Int. Cl.
*F41A 9/27* (2006.01)
*F41A 9/74* (2006.01)

(52) U.S. Cl.
CPC .... *F41A 9/27* (2013.01); *F41A 9/74* (2013.01)

(58) Field of Classification Search
CPC ..... F41A 9/73; F41A 9/74; F41A 15/02; F41A 9/27; F41A 9/28
USPC ..... 89/33.02, 33.03
See application file for complete search history.

(56) References Cited

U.S. PATENT DOCUMENTS

| | | | | |
|---|---|---|---|---|
| 306,564 | A | 10/1884 | Warner | |
| 839,978 | A | 1/1907 | Adrianson | |
| 1,236,608 | A | 8/1917 | Sedgley | |
| 1,487,722 | A * | 3/1924 | Coenders | 89/144 |
| 2,835,171 | A | 5/1958 | Lyon | |
| 2,865,126 | A * | 12/1958 | Dardick | 42/60 |
| 3,123,928 | A | 3/1964 | Lizza | |
| 3,124,889 | A * | 3/1964 | Hellstrom | 42/59 |
| 3,387,399 | A | 6/1968 | McClenahan | |
| 3,407,526 | A * | 10/1968 | Freed | 42/59 |
| 3,747,249 | A * | 7/1973 | Ouellette | 42/50 |
| 3,765,116 | A * | 10/1973 | Zaid | 42/89 |
| 4,156,981 | A | 6/1979 | Lusk | |
| 4,426,802 | A | 1/1984 | Walker | |
| 4,539,889 | A | 9/1985 | Glock | |

(Continued)

FOREIGN PATENT DOCUMENTS

GB 2168795 A 6/1986

OTHER PUBLICATIONS

Armsel Striker, http://en.wikipedia.org/wiki/Armsel_Striker, accessed Aug. 3, 2012.

(Continued)

*Primary Examiner* — Stephen M Johnson
(74) *Attorney, Agent, or Firm* — Stiennon & Stiennon

(57) ABSTRACT

A revolver type cylinder with a plurality of chambers for a shotgun. The rotating cylinder is generally hexagonal in cross-section and formed as an injection molded plastic part with openings that receive metal chamber sleeves. The cylinder has a rotation axis and a seventh opening surrounding the axis. The cylinder is mounted to, and rotatable on a receiver on a rotor and a cylinder pin captured within the seventh opening so as to prevent rotation of the cylinder pin with respect to the cylinder body. The cylinder pin has portions forming a central axial opening which extends along the rotational axis and a spring arranged to retract the cylinder pin into the cylinder body. A trigger linkage is mounted for movement in the central axial opening for linking a trigger to a firing mechanism through the opening.

10 Claims, 7 Drawing Sheets

(56) References Cited

U.S. PATENT DOCUMENTS

| | | | |
|---|---|---|---|
| 4,709,617 | A | 12/1987 | Anderson |
| 4,856,410 | A | 8/1989 | Anderson |
| 4,867,039 | A | 9/1989 | Dobbins |
| 4,882,973 | A | 11/1989 | Piscetta |
| 5,852,253 | A | 12/1998 | Baricos et al. |
| 6,135,005 | A | 10/2000 | Dobbins |
| 6,415,701 | B1 | 7/2002 | Dobbins |
| 7,523,578 | B2 | 4/2009 | Ghisoni |
| 7,536,817 | B2 | 5/2009 | Storch |
| 2003/0046851 | A1 | 3/2003 | Papadimas |

OTHER PUBLICATIONS

Atchisson Assault Shotgun, http://en.wikipedia.ort/wiki/Atchisson_Assault_Shotgun, accessed Aug. 3, 2012.

KAC Masterkey, http://en.wikipedia.org/wiki/KAC_Masterkey, accessed Aug. 3, 2012.

M26 Modular Accessory Shotgun System, http://en.wikipedia.org/wiki/M26_Modular_Accessory_Shotgun_System, accessed Aug. 3, 2012.

M203/M203A1 Grenade Launcher, http:/www.army.mil/factfiles/equipment/individual/m203.html, accessed Aug. 3, 2013.

Striker/Streetsweeper/Protecta, http://nazarian.no/wep.asp?id=479&group_id=2&country_id=48&1a . . . , accessed Aug. 29, 2012.

Manville Gas Gun, http://en.wikipedia.org/w/index.php?title=Manville_gun&oldid=588263166, dated Dec. 29, 2013.

Hawk MM-1, http://en.wikipedia.ort/w/index.php?title=Hawk_MM-1&oldid=587534262, dated Dec. 24, 2013.

MM-1 40mm grenade launcher (USA), http://world.guns.ru/grenade/usa/mm-1-e.html, accessed Jan. 6, 2014.

Milkor MGL revolver type grenade launcher (South Africa), http://world.guns.ru/grenade/safr/milkor-mgl-e.html, accessed Jan. 6, 2014.

Exploded Drawing and Parts List for Glock 17, http://glock.pro/attachments/glock-pistols/1836d1319544113-exploded-glock-parts-list-glock-parts-1-.jpg, accessed Jan. 6, 2014.

International Search Report for PCT/US2015/010691 dated Mar. 23, 2015.

Written Opinion of the International Searching Authority for PCT/US2015/010691 dated Mar. 23, 2015.

* cited by examiner

REVOLVER CYLINDER FOR A SHOTGUN

CROSS REFERENCES TO RELATED APPLICATIONS

This application is a continuation application of U.S. application Ser. No. 14/150,994 filed on Jan. 9, 2014, now U.S. Pat. No. 8,839,709 which issued on Sep. 23, 2014, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to shotguns in general and to bullpup shotguns incorporating a revolver style cylinder containing multiple shotgun rounds.

Many of the features of a shotgun which make it useful for relatively short-range hunting, also makes it useful for short-range defense or offense, particularly when a relatively short barrel is used. A shotgun by its nature is a relatively short-range weapon in comparison to a rifle. Shotguns have relatively low chamber pressures and muzzle velocities—typically a third to one half that of a rifle, and often have a smooth bore rather than rifled barrels. Shotguns are relatively short-range devices with a maximum range of only 700-2,000 feet for shot loads, and an effective range for self-defense of perhaps 50 feet. Using a short barrel on a shotgun has relatively little effect on this effective range. Shotguns also can employ a wide variety of ammunition with generally relatively large total projectile mass of varying area effect. By selecting the proper ammunition, immediate knockdown can be achieved with relatively little penetration of structures, thereby preventing collateral damage. The rifle, on the other hand is effective, at long ranges being accurate and effective at ranges of between 300 and over 1,000 yards. Rifle use in close combat or defense, especially in urban settings, may result in unintended casualties, as a rifle round will typically travel through multiple structures before coming to rest. For many military and police actions both the rifle and the shotgun offer advantages, and when arming for a particular mission or situation at times it will not be clear whether a shotgun or rifle will be most effective. In some situations it may even be such that both capabilities will be needed nearly simultaneously, and yet generally carrying both weapons and being able to use them simultaneously is impractical.

Shotguns have been developed which mount under the barrel of a rifle providing the advantage of having both guns incorporated into a single weapon.

Advantageously a shotgun for mounting under a rifle barrel should be lightweight, with the center of gravity positioned as rearwardly aspossible, it should provide for multiple shots, be readily loaded with different types of ammunition, and have an action which is not dependent on gas pressure or recoil effect.

SUMMARY OF THE INVENTION

The shotgun of this invention has a receiver having an uppermost rail mount for mounting to a rail under the barrel of a rifle or to a rail on a stock. A shotgun barrel is mounted to the receiver. A six chambered plastic cylinder is rotatably mounted to the receiver behind the barrel, to successively bring a chamber of the cylinder into alignment with the barrel. A trigger is mounted in front of the cylinder with a trigger mechanical train passing through the center of the cylinder to actuate a fire mechanism at the rear of the cylinder. Each of the six chambers in the cylinder has a metal liner which receives a shotgun shell. The receiver includes a trigger guard, an ambidextrous trigger safety mounted above the trigger guard, and a downwardly facing slot through which a cylinder release lever is mounted. A lower grip is mounted to the receiver below the rail mount and in front of the cylinder. The shotgun cylinder is similar to those found in a pistol type revolver which successively brings each of the six rounds held in the six chambers into alignment with the barrel and the firing mechanism. The rotating cylinder functions as a magazine which can be released from and dropped below the gun frame by the cylinder release lever which passes through the slot in the receiver. After release from the receiver, the cylinder can be reloaded or replaced by a second loaded cylinder. The shotgun has a double action trigger which rotates the barrel to bring one chamber of the cylinder into alignment with the gun barrel, moves a sleeve mounted to the barrel to engage a protruding lip of one of the cylinder liners thereby locking the cylinder in battery, cocks a hammer, and then trips the hammer sear dropping the hammer on the firing pin which initiates the discharge of the shotgun round in the chamber. Alternatively a striker type mechanism may be employed.

It is an object of the present invention to provide a shotgun for mounting under the barrel of a rifle which has a forward positioned trigger in front of the gun action such that one hand can be positioned to pull the rifle's trigger, while the other hand can be positioned to support the shotgun and the rifle under the rifle barrel and to simultaneously actuate the shotgun trigger.

It is another object of the present invention to provide a compact shotgun of reduced overall length.

It is further object of the present invention to provide a double action shotgun with all actuation mechanisms located below the barrel for single-handed operation.

It is a yet further object of the present invention to provide a bullpup type arrangement for a shotgun.

It is a still further object of the present invention to provide a weapon for both long-range engagement and close-range engagement.

Further objects, features and advantages of the invention will be apparent from the following detailed description when taken in conjunction with the accompanying drawings.

DESCRIPTION OF THE PREFERRED EMBODIMENTS

Figure 1:
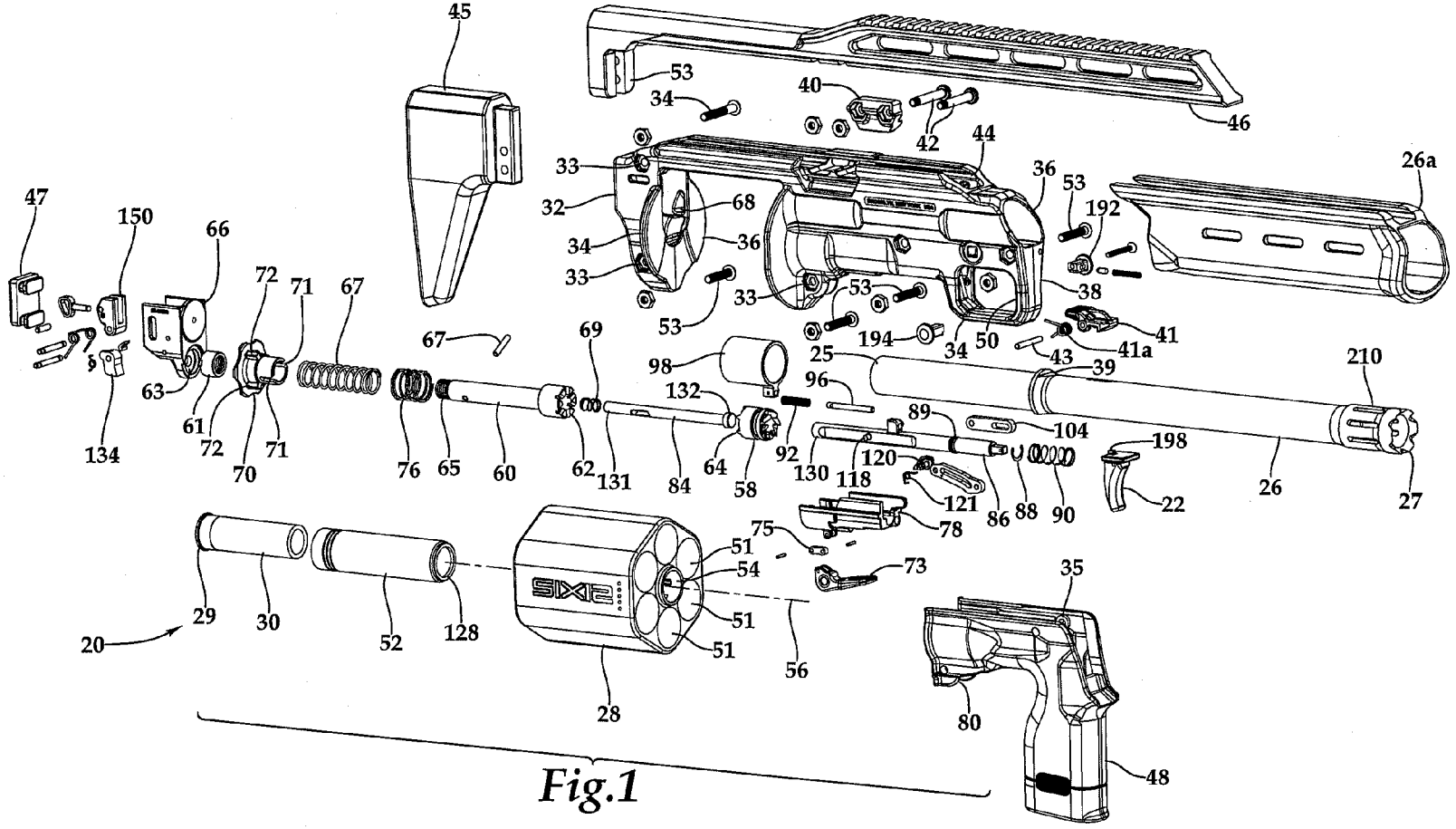
FIG. 1 is an exploded axonometric view of the shotgun of this invention.
Figure 3:
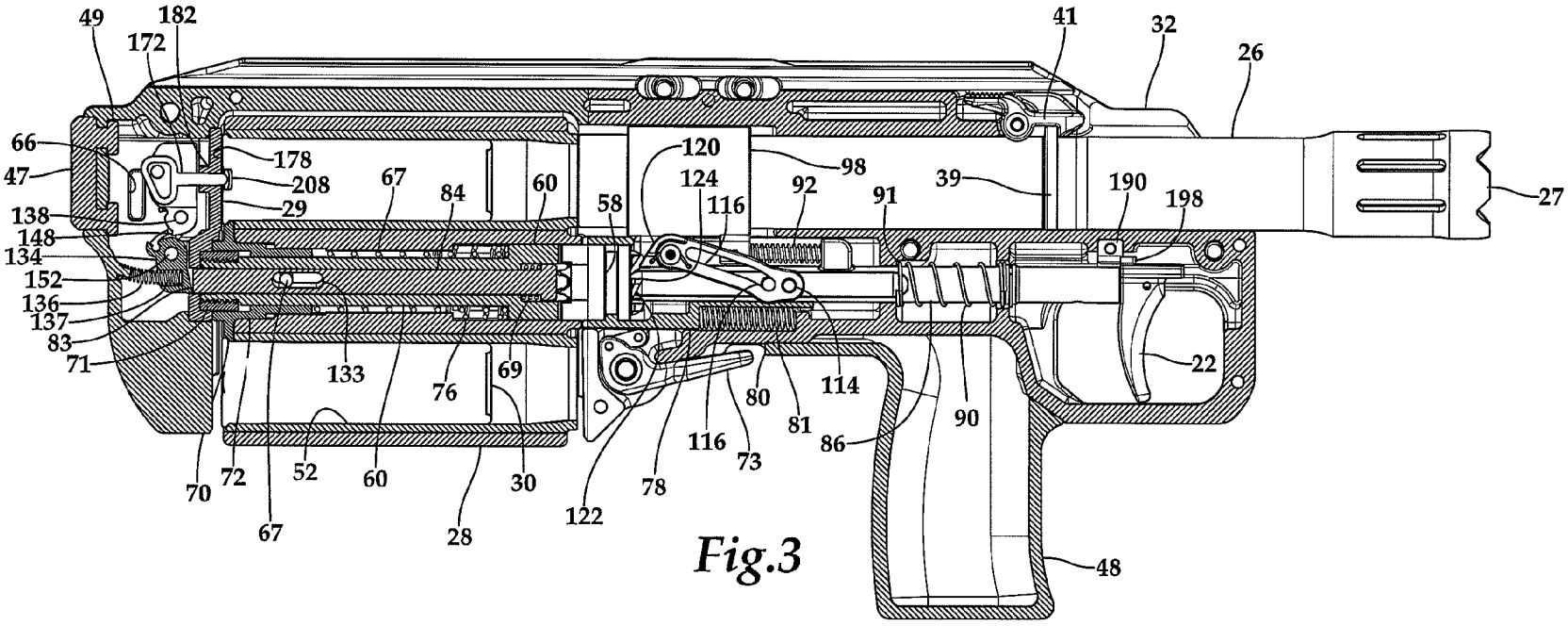
FIG. 3 is across-sectional view of the shotgun of FIG. 1, showing the trigger mechanism, the cylinder release mechanism, the blast collar linkage, the pawl linkage for cylinder rotation, and the fire control housing and mechanism.
Figure 4:
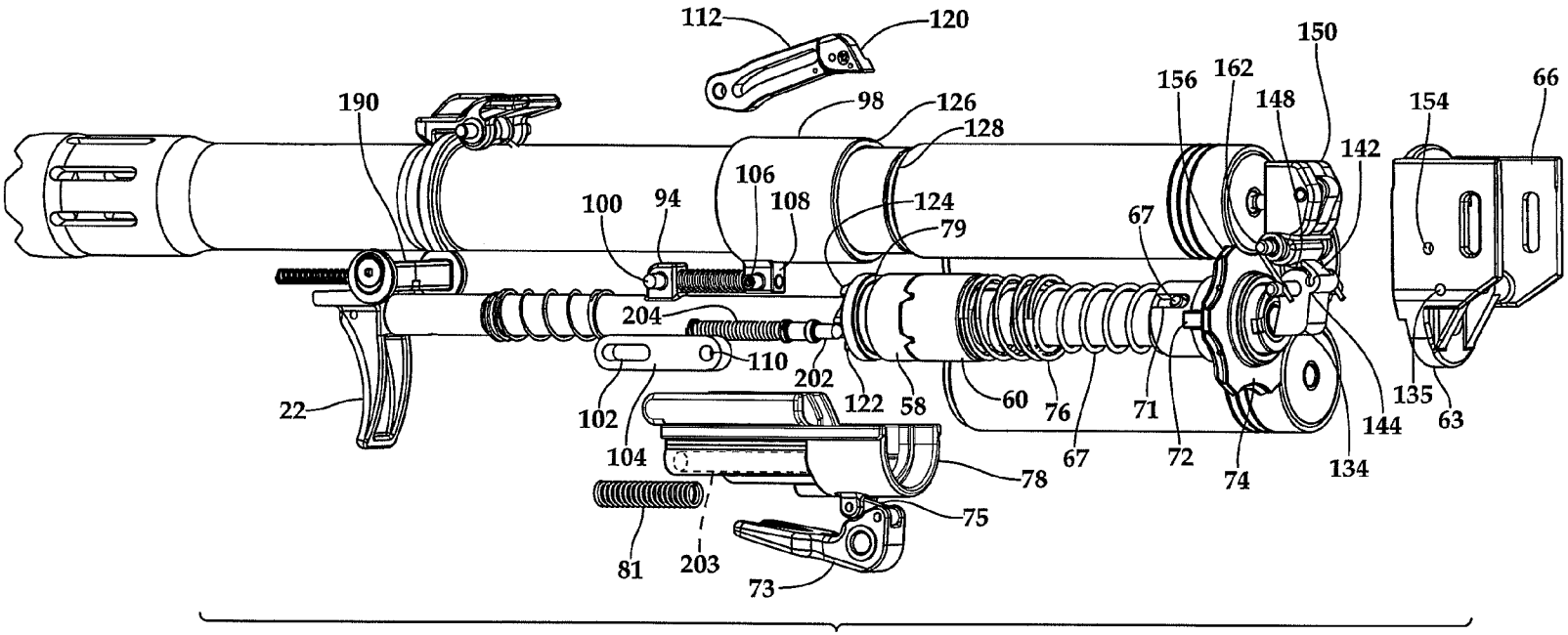
FIG. 4 is fragmentary axonometric exploded view of the shotgun of FIG. 1, showing the main functional mechanisms.
Figure 5:
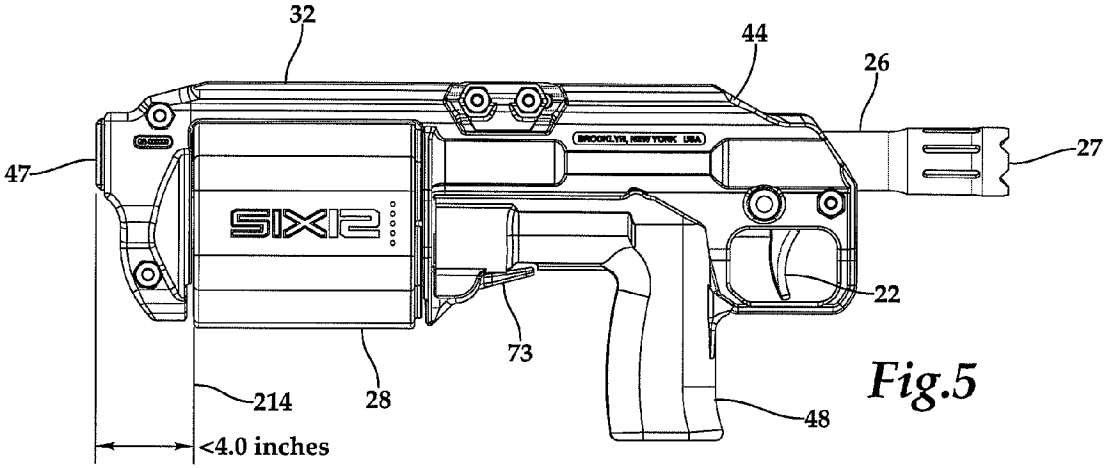
FIG. 5 is a front elevational view of the shotgun of FIG. 1.

Referring more particularly to FIGS. 1-7, wherein like number refer to similar parts, a shotgun 20 is shown in FIG. 5. The shotgun 20 is a rail-mounted bullpup type firearm, having the trigger 22 mounted in front of the action. The action, as shown in FIG. 1, comprises a shell chamber 24 and a fire control in a housing 66 positioned behind a shotgun rotating cylinder 28. The action is of the revolver type with the rotating cylinder 28 having six chambers 24 which each hold a conventional or special purpose shotgun shell 30 e.g., 4, 8, 10, 12, 16, 20, or 0.410 gage.

Figure 6:
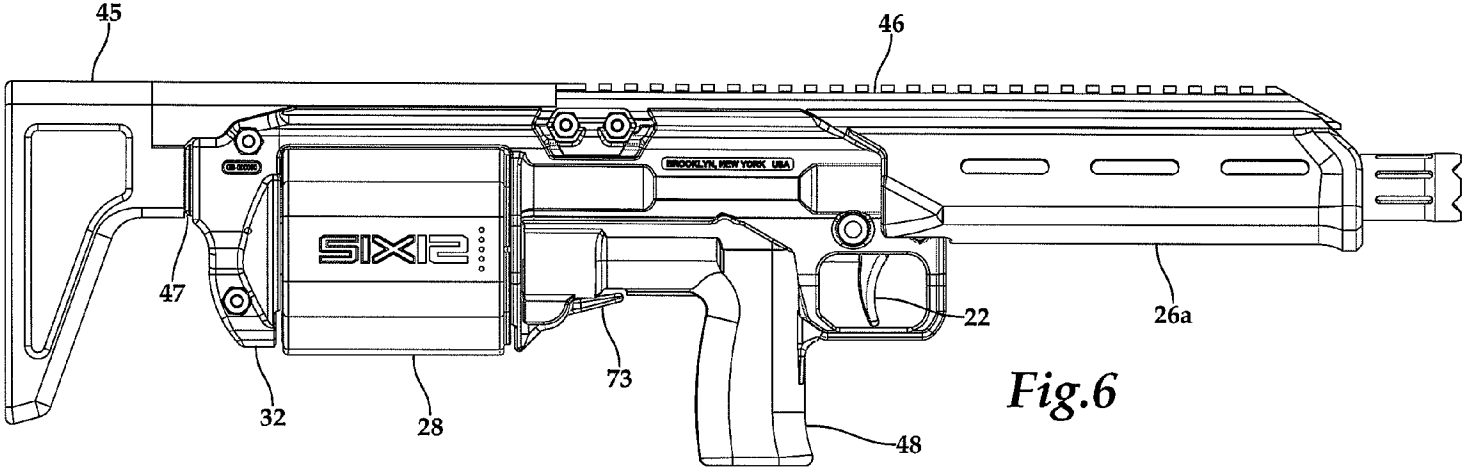
FIG. 6 is a front elevational view of the shotgun of FIG. 1. mounted to a forward extending rail of a stock.
Figure 7:
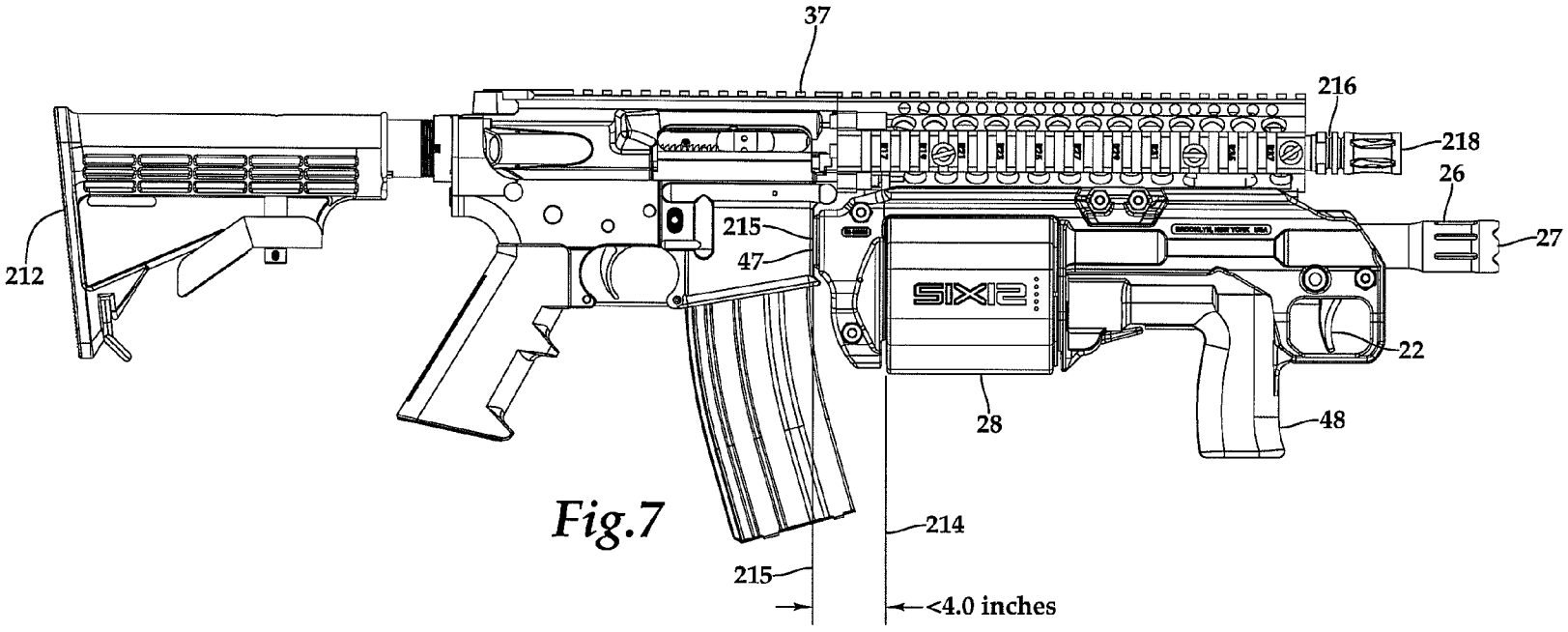
FIG. 7 is a front elevational view of the shotgun of FIG. 1 rail mounted beneath the barrel of a rifle.

The shotgun 20 has a receiver 32 composed of a right-hand side 34 joined to a left-hand side 36 along a parting line 38 by a clamp 40 held by bolts 42. The clamp 40 further forms part of the shotgun rail track 44 which mounts the shotgun to a rail 46 joined to a stock 45, as shown in FIGS. 1 and 6, or beneath the barrel 216 of a conventional rifle 37 as shown in FIG. 7. With this mounting arrangement the shotgun is supported beneath the barrel 216 of the rifle 37 so the shotgun barrel 26 extends parallel to and beyond the end 218 of the rifle barrel 216. The receiver 32 is further held together by bolts 53 shown in FIG. 1 which extend through holes 33 in the receiver 32.

The barrel 26 is fixed to the receiver 32 against forward movement by a barrel locking ring 39 which engages with a retainer 41 which can be released by depressing the retainer against a spring 41*a*. The retainer 41 is pinned to the receiver 32 by a pin 43. The barrel has a breach end 25 which receives a slug or shot load from a shell 30 in the chamber 24 in the cylinder 28, and a muzzle end 27 where a round exits the barrel. The barrel 26 is protected by a barrel grip 26*a* which slides over the rail 46 and resiliently snaps on to the receiver with opposed inward projections (not shown) which overlie the forwardmost bolt hole 33 on the receiver.

A recoil pad 47, as shown in FIGS. 1, 3, and 5-7, is partly recessed into a pad receptacle 49 on the rear of the receiver 32, as shown in FIG. 3, to resiliently support the shotgun 20 on a vertical land 53 at the end of the rail 46 as shown in FIGS. 1, 6 and 7. The fire control housing 66 engages directly the receiver on either side of the recoil pad 47. A trigger housing 50 is formed as part of the receiver 32. A hand grip 48 snaps on to the receiver 32 with two groups of two opposed inward projections 35 on the hand grip which snap in to recesses on the receiver formed by the holes 33 for the bolts 53 which underlie the hand grip.

The rotating cylinder 28 is generally hexagonal in cross-section and formed as an injection molded plastic part with six symmetrically arranged openings 51 that receive six metal chamber sleeves 52, which form the shell chambers 24 in the cylinder. The cylinder 28 holds six shotgun shells 30. A seventh opening 54 surrounds the rotational axis 56 about which the cylinder 28 rotates and about which the six openings 51 and the chamber sleeves 52 are symmetrically arranged. The cylinder 28 is mounted to, and rotates on, the receiver 32 on a rotor 58 and a cylinder pin 60, as shown in FIGS. 1 and 4. The cylinder pin 60 has a retaining nut 61 threaded to the rear end 65 of the cylinder pin which retains an ejector plate 70, and engages a sheave 63, best shown in FIG. 2, formed by the fire control housing 66. The fire control housing 66 in turn is mounted to a fire control housing opening 68 in the rear of the receiver 32 as shown in FIGS. 1 and 3. The fire control housing 66 forms an extension of the receiver 32 which supports on a chamber face 178 the brass base 29 of a chambered shell 30. The cylinder pin 60 is retained within the cylinder 28 by cross pin 67 which engages opposed slots 71 in the ejector plate 70 as shown in FIGS. 1 and 4. The ejector plate 70 is in turn constrained against rotation with respect to the cylinder 28 by radial projections 72 on the ejector plate, shown in FIGS. 1 and 4, which slide in corresponding grooves (not shown) forming part of the opening 54 about the axis 56 of the cylinder 28. The rotor 58 and the cylinder pin 60 in normal operation are linked together by interlocking toothed surfaces 62, 64 on the cylinder pin and the rotor respectively.

As shown in FIGS. 3 and 4, the ejector plate 70 is mounted on the end of the cylinder pin 60 facing the sleeve 63 in the fire control housing 66 so that the ejector plate is movable linearly along the cylinder pin. The ejector plate 70 opposed slots 71 shown in FIGS. 1 and 4 allow the ejector plate to slide along the cross pin 67. The ejector plate 70 has six extraction surfaces 74 which each engage a short arc of the rim of one of the six shotgun shells 30. The ejector plate 70 is biased by an ejector spring 76 so that when the cylinder 28 is removed from the shotgun 20, the ejector plate moves rearwardly a short distance extracting the shotgun shell cases allowing them to be dropped from the cylinder. If necessary, the aggressive toothed surface 62 of the cylinder pin 60 can be depressed with a finger, to aid the spring 76 in extracting the spent shotgun shells 30.

As shown in FIG. 3 the cylinder 28, the cylinder pin 60, the springs 67, 76, 69, the rear trigger link 84 and the pin 67 form a single joined cylinder unit which can be only be disassembled by removing the retaining nut 61. As shown in FIG. 4, to reload the cylinder 28 the cylinder unit is released to drop below the receiver by the rearward rotation of a release lever 73 mounted to the receiver 32, as shown in FIG. 1, by the bolt 53 passing through the hole 33 just in front and adjacent the lower part of the cylinder 28. The release lever 73 is arranged connected by a link 75 to provide mechanical advantage in moving the cylinder release 78 forward in a slot 80 in the grip 48 against a cylinder release spring 81 as shown in FIGS. 3 and 4. Movement of the U-shaped cylinder release 78 is supported on the receiver by rails 82 best shown in FIG. 4. The cylinder release 78 engages a groove 79 in the rotor 58 causing it to slide along a rear trigger linkage bar 84 so disengaging the toothed surface 62 of the cylinder pin 60 and the toothed surface 64 of the rotor and moving the rotor forward. An ejector spring 76 retracts the cylinder pin 60, disengaging the retaining nut 61 and rearward end of the cylinder pin 60 from the sleeve 63 in the fire control housing, and disengaging the cylinder 28 from the receiver 32, allowing the cylinder unit to fall free of the gun 20. To replace the cylinder 28 the ejector plate 70 is held depressed with a finger of one hand while the release lever 73 is held in the rearward rotated position.

The trigger group, as shown in FIGS. 1, 3 and 4, is composed of three main parts: the trigger 22, which is connected to a forward trigger link 86, which abuts a rear trigger link 84 which extends through and beyond the cylinder 28. Pulling the trigger 22 causes the entire trigger group to move rearwardly until the rear trigger link 84 engages a fire control mechanism contained in the fire control housing 66, causing the round in the chamber sleeve 52 which is aligned with the barrel 26 to be initiated. A trigger spring 90 is mounted around the forward trigger link 86 between a C clip 88 mounted in a groove 89 in the forward trigger link and portions 91 of the receiver, best shown in FIG. 3, to urge the forward trigger link and the trigger 22 forward toward the breach of the barrel. Thus when the trigger 22 is released, the forward trigger link 86 with the trigger 22 mounted thereto is moved forward and separates from the rear trigger link 84 and returns the trigger to the undepressed ready position as shown in FIG. 3.

Before depression of the trigger 22 causes actuation of the fire control components in the fire control housing 66, the rearward movement of the forward trigger link 86 causes two additional functions. As shown in FIG. 4, the forward trigger link 86 has an upwardly projecting post 94 which has a through hole (not shown) which receives a rod 96 mounted to a blast collar 98. The post 94 has an integral and leftwardly extending pin 100 which is captured in a slot 102 of a blast collar link 104. A hole 110 in the link 104 is connected to a rightwardly extending pin 106 forming part of a downwardly extending blast collar post 108. The link 104 is shown exploded away in FIG. 4. As the trigger 22 is depressed the forward trigger link 86 moves rearwardly so that the through hole (not shown) in the integrally formed post 94 slides along the blast collar rod 96 compressing the blast collar spring 92 as the pin 100 slides within the slot 102 such that the slot in the link 104 forms an alignment guide between the blast collar and the forward trigger link 86. Thus the first stage of motion of the trigger 22 and the forward trigger link 86 compresses the spring 92 which moves the blast collar 98 rearwardly.

The first stage of motion of the trigger 22 and the forward trigger link 86 also performs a second function, which is to rotate the cylinder 28 bringing a chamber sleeve 52 and the shotgun shell 30 contained therein into alignment with the barrel 26. The second function is accomplished, as shown in FIG. 3, by a pawl 112. The pawl 112 is mounted to a pin 114 integrally formed with the cylinder release 78 such that the pin extends leftwardly towards the forward trigger link 86. The pawl 112 has an upwardly extending linear slot 116 which is captured on a rightwardly extending pawl drive pin 118 integrally formed with the forward trigger link 86. The pawl 112 has a pivoting tooth 120 opposite the end of the pawl which is pinned to the cylinder release 78. The pawl tooth 120 engages one of a series of frontwardly projecting teeth 122 formed on the rotor 58. During return to the pre-trigger pull position, the pawl tooth 120 rotates on the pawl 112 against a spring 121 to pass by one of the frontwardly projecting teeth 122. The rotor 58 is engaged by its toothed surface 64 with the toothed surface 62 of the cylinder pin 60. The cylinder pin 60 in turn rotates the cylinder 28 by the cross pin 67 which engages the ejector plate 70 which is locked to rotate with the cylinder by the projection 72. During the first stage of trigger pull, the rearward motion of the trigger 22 and the forward trigger link 86 drives the pawl drive pin 118 rearwardly along the slot 116 in the pawl, causing the pawl to rotate downward to engage a momentarily upwardly facing surface 124 of one of the teeth 122 of the plurality of teeth of the toothed surface 64 on the rotor 58 thereby pushing downwardly on the tooth to rotate the cylinder 28 and bring a chamber sleeve 52 and the shotgun shell 30 contained therein into alignment with the barrel 26.

The two functions of the first stage of the trigger pull occur substantially simultaneously, however the spring 92 is selected such that the cylinder 28 begins to rotate before the blast collar 98, as shown in FIG. 4, begins its rearward motion. This causes the leading lip 126 of the blast collar to overlap with the forward sealing rim 128 of at least one chamber sleeve 52. As rearward motion of the trigger 22 and the forward trigger link 86 continues, the blast collar spring 92 compresses the blast sleeve lip 126 against the sealing rim 128 of the chamber sleeve 52 while the pawl 112 drives the rotation of the cylinder until the chamber sleeve is aligned with the barrel 26. When the chamber sleeve 52 is aligned with the barrel 26 the blast collar snaps into engagement around the sealing rim 128 of the chamber sleeve locking rotation of the cylinder 28 with a chamber sleeve and a shotgun shell 30 aligned with the barrel 26.

Continued rearward movement of the trigger 22 and the forward trigger link 86 brings the rear surface 130 of the forward trigger link 86, shown in FIG. 1, into engagement with the front end 132 of the rear trigger link 84. The rearward movement of the trigger 22 and the forward trigger link 86 causes the rear trigger link 84 to slide rearwardly within the cylinder pin 60, with the rear trigger link cross slot 133 moving along the retained cross pin 67. The rear 131 of the rear trigger link 84 thereby engaging and rotating the sear carrier 134 which is biased forwardly by a spring 136.

As shown in FIGS. 2-4, firing of the shell 30 which is aligned with the barrel 26 commences with rotation of the sear carrier 134. The sear carrier 134 rotates on a first pin 152 mounted to fire control housing 66 by holes 135 in the fire control housing shown in FIGS. 2 and 4 on the lower part of the fire control housing. The rearward motion of the rear trigger link 84 so that the rear face 131 of the rear trigger linkage bar bears on the face 83 of the sear carrier 134 to rotate the sear carrier about the sear carrier pin 152 as shown in FIG. 3. This rotation drives the sear 142, rotatably mounted in a groove 144 in the upper surface 146 of the sear carrier 134, shown in FIGS. 2 and 4, against a sear engaging surface 148 in the lowermost portion of a hammer 150. The sear 142 is loaded by a sear spring 143 which is coiled around the sear carrier pin 152 and has an arm 145 which lifts the sear 142, and an arm 147 which is held in a hole 149 in the sear carrier 134. The hammer 150 is mounted by a hammer pin 138 which passes through a hole 153 in the hammer and through two pin receiving openings 154 in the fire control housing 66. A hammer spring 156 has two legs 151 and two coils joined by a C-shaped section. A hammer spring leg 151 is held on one side of the sear carrier pin 152 in a first sear pin groove 158, the hammer spring 156 then extends upwardly and coils around the hammer pin 186, passes behind the hammer 150 in a groove 160, best shown in FIG. 2, and again wraps around the hammer pin and extends downwardly so a second leg 151 engages a second sear pin groove 158 in the sear pin 152. The hammer spring 156 biases the hammer 150 to rotate so that the hammer face 164 moves forward. The hammer face 164 surrounds a slot 170 which passes through the hammer 150.

As shown in FIGS. 2 and 3, a firing pin 172 encompasses three structures: a firing pin proper 174 which passes through a firing pin opening 176 in a circular chamber face 178 on the forward side of the fire control housing 66; a firing pin proper 174 which slides in a firing pin guide 182 integrally formed with the fire control housing and shown in FIG. 3; and an annular drive structure 184 which fits within the hammer slot 170. The firing pin 172 is linked to the hammer 150 by the hammer pin 186 which is held in pin receiving openings 171 in the hammer. The hammer pin 186 passes through an opening in the annular drive structure 184 of the firing pin 172, thereby linking the firing pin to the hammer 150 so the firing pin is driven by the hammer.

The shotgun 20 has several safety features including an ambidextrous safety composed of a trigger safety toggle 190, shown in cross-section in FIG. 3, and having a left safety button 192 and a right safety buttons 194 shown exploded in FIG. 1. The safety toggle 190 underlies the barrel 26 and limits movement of the trigger 22. As shown in FIG. 3, A slot 196 is formed in the lower surface of the toggle 190 which allows passage over a narrow rib 198 on the trigger 22 when the safety toggle slot is centered on the rib. By depressing the left safety button 192, the slot 196 on the toggle 190 is moved to the right allowing the narrow rib 198 on the trigger 22 to be moved rearwardly. A detent plunger 191 and plunger spring 193 hold detents (not shown) on the toggle in both safe and armed positions. The shaft of the right safety button 194 should be red to indicate the armed position of the safety.

An additional safety feature provides a one-way ratchet which prevents the cylinder from rotating in more than one direction. As shown in FIG. 4, the one-way ratchet is formed by a pin 202 driven by a spring 204 against the teeth 122 of the rotor 58. The teeth 122 have sloped sides, as shown in FIG. 3, which depress the pin 202 as the rotor 58 and the cylinder 28 rotate to move shells 30 into battery. The teeth 122 also have axial surfaces which abut the pin, preventing the rotor 58 and the cylinder 28 from rotating in the wrong direction opposite of that which brings shells 30 into battery. The pin 202 and driving spring 204 are housed in a cylindrical opening 203 formed in the cylinder release 78.

One important feature of the shotgun 20 is the way in which the center of gravity of the shotgun is rearwardly positioned so that when the shotgun is mounted to a rifle the handling characteristics of the rifle are not greatly altered such that the gun is hard use. E.g., the rifle with shotgun attached is easily swung into position and held in battery and pointed. In particular, there is an advantageous short spacing of less than about 4 inches measured from a first plane 214 defined by the rear of the cylinder along a line defined by the axis of the barrel to the rearmost part 215 of the shotgun 20. More particularly, the rearmost part of the shotgun is measured in a plane which contains both the central axis of the barrel and the axis of rotation of the cylinder. In other words, the distance is measured between the rear face of the cylinder and a rearmost part of the shotgun which functions as a recoil transmitting structure, e.g. the pad 47 as shown in FIGS. 3 and 5-7 which controls how rearwardly, i.e., toward the butt plate of the rifle 212, see FIG. 7, the shotgun may be mounted under a rifle barrel 216 on the rifle 37. A trigger or other hardware which extends rearwardly along the side of the rifle would thus not form a part of the less than about 4 inches limitation.

The shotgun 20 operates as follows: the safety toggle 190 is pushed into alignment with the rib 198 by depressing the left 192 safety button. As shown in FIG. 3, the trigger 22 is pulled and moves the forward trigger link 86 rearwardly so that the pawl drive pin 118 moves along the slot 116 in the pawl 112 rotating the pawl downwardly to engage a tooth on the rotor 58 to rotate the cylinder 28 clockwise, simultaneously causing rearward movement of the post 94 sliding it along the blast collar rod 96 compress the blast collar spring 92 which biases the blast collar 98 against the rim 128 of a chamber sleeve 52. Continued pressure on the trigger 22 and movement of the pawl 112 brings a chamber 24 in a chamber sleeve 52 into battery where the blast sleeve 98 pops into engagement about the rim 128 of the chamber sleeve 52 locking the cylinder 28 and the chamber 24 formed by the chamber sleeve 52 into battery. Continual pressure on and rearward movement of the trigger 22 causes the forward trigger link 86 to engage the sear carrier 134 and the sear 142 which is biased to stand proud of the sear carrier by a sear spring 143 mounted between the sear carrier and the sear. The sear engages the hammer 150 retracting it against the hammer spring 156. Continued rotation of the sear carrier 134 and the sear 142 cocks the hammer 150, and then rotates the sear engaging surface 148 on the hammer until it no longer engages the sear. This releases the hammer 150 which strikes the firing pin 172 with the hammer pin 186. Under inertial forces the firing pin 172 continues to travel along the firing pin guide 182 driving the firing pin proper 174 through the firing pin opening 176 in the fire control housing 66 and into the primer 208 in the base 29 of the shell 30, as shown in FIG. 3, thus firing the shotgun shell 30 which is in battery.

The shotgun shell load e.g., a slug or buckshot, proceeds down the barrel 26 where shell gases are expelled through flash suppression ports 210 just before the load exits the barrel. Release of the trigger 22 allows the sear spring 143 to rotate the sear carrier 134 and the sear 142. The sear 142 collapses onto the upper surface 146 of the sear carrier 134 and passes under the sear engaging surface 148 of the hammer 150 and the sear spring 143 then raises the sear for the next pull of the trigger. The rear trigger linkage bar 84 is retracted into the cylinder pin 60 by the spring 69 to a pre-fire position. The forward trigger lineage bar 86 and the trigger 22 are moved in by the trigger spring 90, thus releasing and retracting the blast collar 98, returning the pawl 112 and the blast collar link 104 to their pre-trigger pull positions. Meanwhile the rotation directional control plunger 202 holds the cylinder 28 with the just fired chamber sleeve 52 aligned with the barrel in readiness for the next trigger pull.

A second and subsequent trigger pulls repeats the foregoing process firing another round from the shotgun 20 until all the shotgun shell rounds 30 are expended. At which point the cylinder 28 may be dropped from the receiver 32 and reloaded or replaced with a second loaded cylinder. The cylinder 28 is removed by actuation of the cylinder release 73 which moves the cylinder release 78 and retracts the rotor 58. With the rotor 58 retracted from the cylinder, the rear trigger linkage bar 84 will move with the cylinder pin 60 under the action of the ejector spring 76 freeing the cylinder pin retaining nut 61 from the housing sleeve 63 with the retraction of the rotor 58 to drop free of the receiver 32.

Figure 2A:
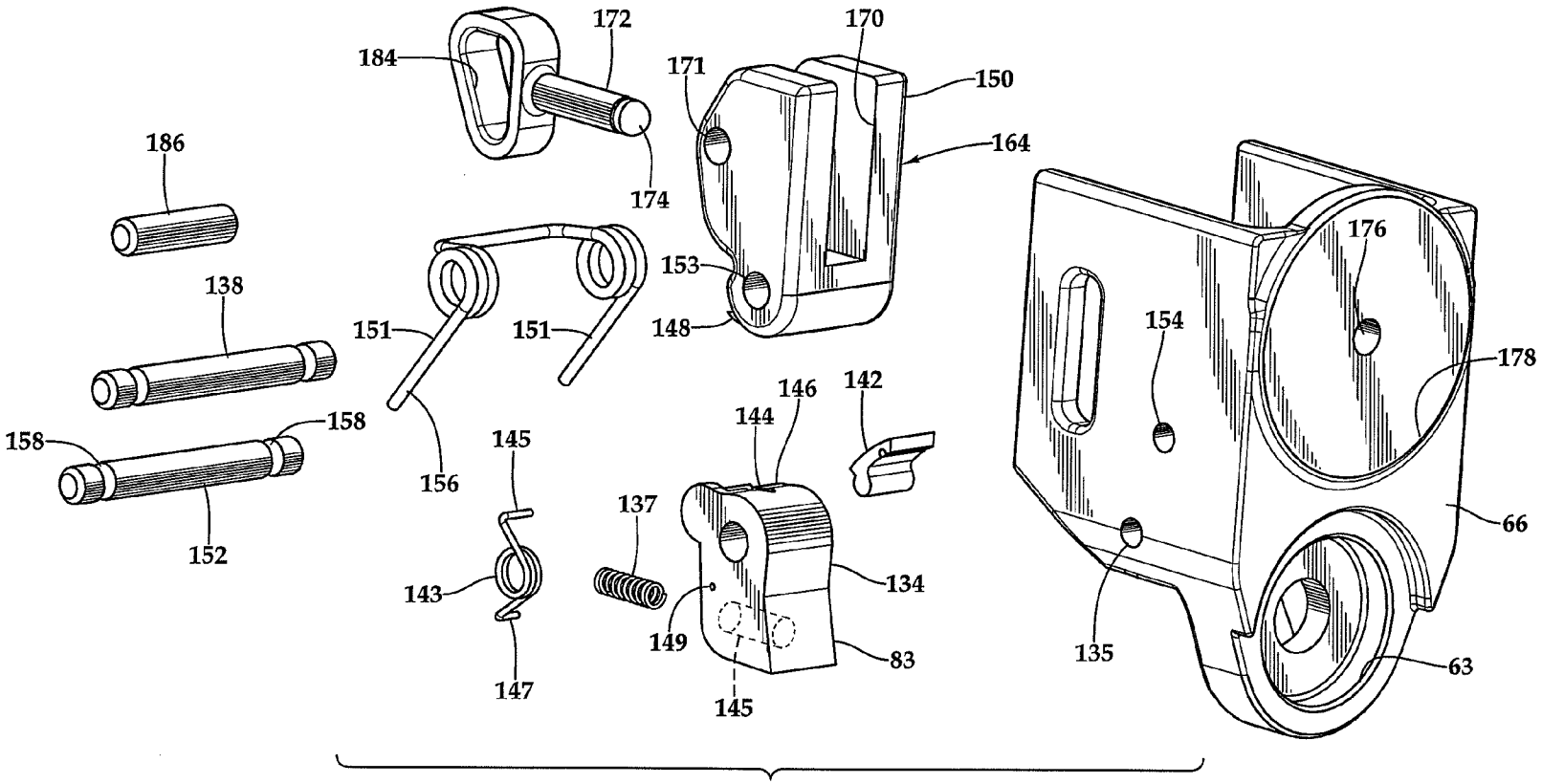
FIG. 2*a* is an exploded axonometric view of the fire control housing and fire control mechanism with a hammer and firing pin of the shotgun of FIG. 1.
Figure 2C:
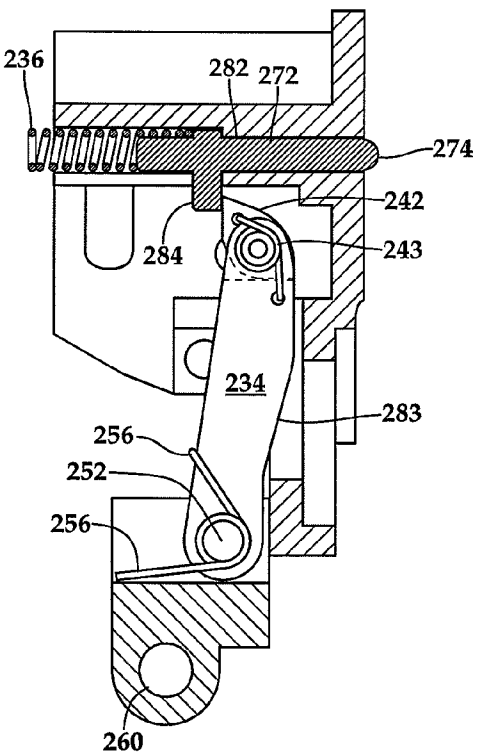
FIG. 2*c* is a a cross-sectional view of the assembled fire control housing and fire control mechanism of FIG. 2*b*.
Figure 2B:
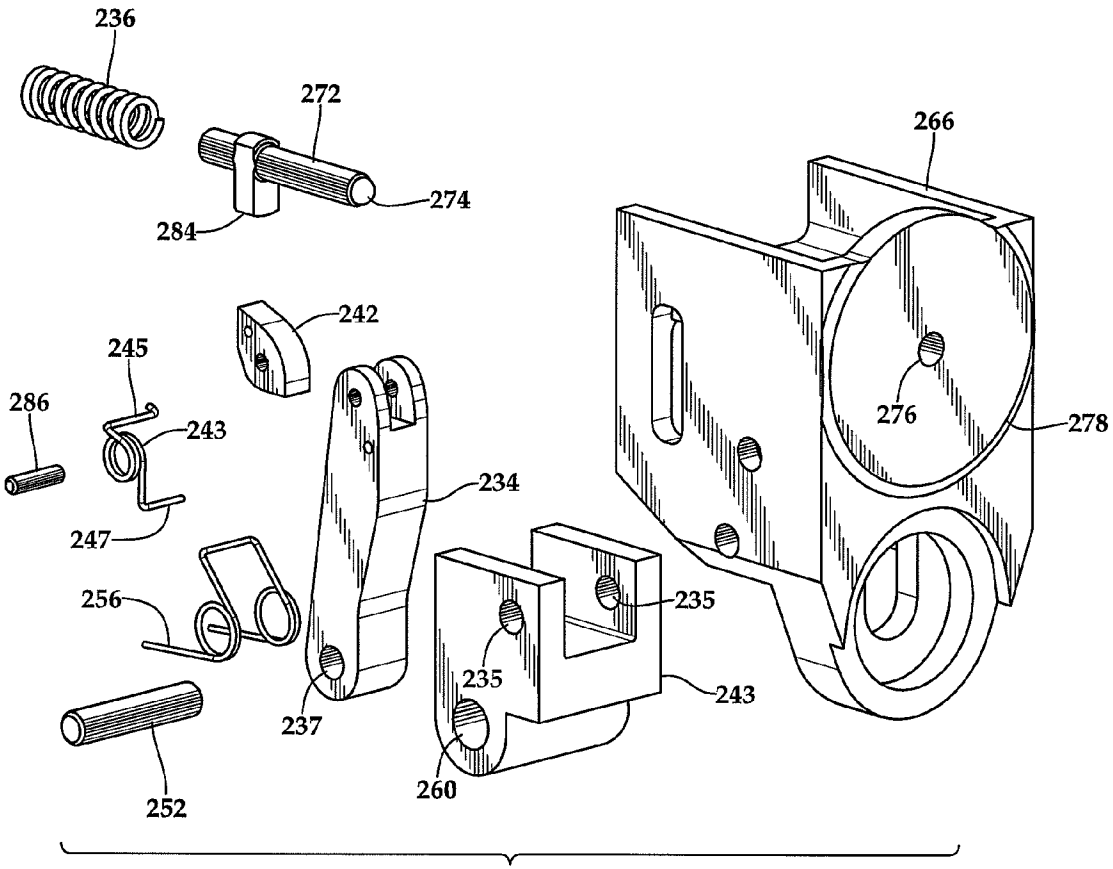
FIG. 2*b* is an exploded axonometric view of an alternative embodiment fire control housing and fire control mechanism employing a striker for the shotgun of FIG. 1.

The fire control housing 66 and fire control mechanism shown in FIG. 2A can be replaced with a striker mechanism in a striker housing 266 and striker mechanism as shown in FIGS. 2B and 2C. Referring to FIG. 2C, the firing pin is replaced with a striker 272 which slides in a striker guide 282 forming part of the housing 266. The striker 272 is biased by a spring 236 so as to move toward a striker opening 276 so that a portion of the striker forming a pin 274 passes through the chamber face 278 and strikes the primer 208 shown in FIG. 3. The striker housing 266 mounts in the same position as the fire control housing 66 in the shotgun 20. The striker mechanism is actuated by the same movement of the rear trigger linkage bar 84. The rear end 131 of the rear trigger linkage bar 84 presses on a forward facing surface 283 of a cocking arm 234 which is pivotally mounted by a pin 252 passing through a hole 237 in the arm, and holes 235 in a support base 243. The support base 243 has an opening 260 which is mounted about the rear lower bolts 53 as shown in FIG. 1. The cocking arm 234 pivots on the pin 252 against an arm return spring 256 so that a striker pawl 242 engages against the catch 284 on the striker 272 retracting the striker against the striker spring 236. As the cocking arm continues its rearward rotation the striker pawl 242 passes under the catch 284 allowing the striker pin 274 to initiate the primer and the round in the chamber behind the barrel 26. After the round is fired, the cocking arm 234 is rotated to the pre-fire position by arm spring 256, during this rotation the striker pawl 242 rotates rearwardly on a pin 286 to pass under the striker catch 284, and is returned to the ready to fire position by a pawl spring 245.

It should be understood that when reference is made to directions in the description forward indicates towards the muzzle of the barrel, rearward is in the opposite direction, and right and left refer to the sides of the gun in reference to the operator firing the gun and rotational directions are defined with reference to the same operator. Furthermore, the term "in battery" means locked and ready to fire. And the term "bull-pup" means a firearm configuration in which the action is located behind the trigger so there is no wasted space in the buttstock or mounting as in conventional designs. This permits a shorter firearm length for the same barrel length for improved maneuverability, and reduces weight.

It should also be understood that the receiver 32 is the part of the gun which holds the mechanical parts together e.g., the cylinder 28, the trigger housing, the breach lock formed by the fire control housing 66 forming the circular chamber face 178, the barrel 26, the trigger 22 and the linkages 86, 84; and the fire control group housed in the fire control housing 66. The receiver can be in two or more parts (e.g., AR-15 and the AR-10) which usually are linked together, and some mechanical parts may be linked to the receiver by intermediate parts.

It should be understood that ammunition of various sizes and configuration could be used in the shotgun 20 e.g., using a chamber adapter such as sold by GaugeMate of Rancho Cordova, Calif.

It should also be understood that where six rounds are described and illustrated, the number of rounds could be varied.

It should also be understood that in the claims where a component is referred to as a spring, the term spring includes generally any biasing member e.g., a gas piston, coil spring, a belleville spring, a leaf spring, or a compressible resilient member.

Further it should be understood that the fire control housing 66 may incorporate a pre-set hammer or striker mechanism.

The barrel length of the shotgun will generally be chosen either to meet the 18-inch limitation, as shown in FIG. 7, or in the case of military use, shown in FIGS. 5 and 6, the barrel may be considerably shorter.

It is understood that the shotgun 20 may be connected to a rifle, a machine gun, a stock or even a shotgun, or any other piece of military or defensive equipment, with or without a rail, so it is separable from such gun or equipment, or integrally formed. For example, a receiver might contain the components of the shotgun 20 as well as the components making up a rifle. As such, a shotgun may or may not have a rail or a rail track for mounting to a rail.

It is understood that the invention is not limited to the particular construction and arrangement of parts herein illustrated and described, but embraces all such modified forms thereof as come within the scope of the following claims.

We claim:

1. Portions of a shotgun comprising:

a cylinder body defining a rotational axis;

wherein the cylinder body has portions forming an opening centered about the rotational axis and extending through the cylinder body;

wherein the cylinder body has portions defining at least part of each of a plurality of shotgun shell receiving chambers which are parallel to and equally spaced from the rotational axis;

wherein the shotgun shell receiving chambers have first ends on a first side of the cylinder body arranged to receive shotgun shell bases, and wherein the receiving chambers have second ends on a second side of the cylinder body which are parallel to and opposite the first side, the receiving chamber second ends defining openings through which a shotgun round exits;

wherein a first direction along the rotational axis is defined from the first side to the second side;

a cylinder pin captured within the opening centered about the rotational axis so as to prevent rotation of the cylinder pin with respect to the cylinder body;

wherein the cylinder pin has a first end and a second end and extends from the first end to the second end in the first direction;

wherein the cylinder pin has portions forming a central axial opening which extends along the rotational axis;

a spring arranged to retract the cylinder pin into the cylinder body toward the second side of the cylinder body; and a trigger linkage mounted for movement in the opening centered about the rotational axis, the trigger linkage extending in the first direction for linking a trigger to a firing mechanism through the opening centered about the rotational axis; and an extractor mounted to the cylinder body on the first side of the cylinder body for movement in a second direction opposite the first direction, the extractor having portions which define at least a part of the plurality of shotgun shell receiving chambers so that shotgun shell bases of shotgun shells placed in the shotgun shell receiving chambers engage the extractor portions and are extracted by a movement of the extractor in the second direction.

2. The cylinder of claim 1 wherein the trigger linkage is retained on the cylinder body.

3. The cylinder of claim 1 further comprising a spring engaging the extractor and arranged to bias the extractor in the second direction.

4. The cylinder of claim 1 further comprising a retainer removably mounted to the cylinder pin first end, for retaining the cylinder pin on the cylinder body.

5. The cylinder of claim 1 wherein portions of the cylinder body forming the second ends of the shotgun shell receiving chambers define forward sealing rims having a ring like shape on the second side of the cylinder body.

6. The cylinder of claim 1 wherein the cylinder body is composed of a first material, and wherein each of the plurality of shotgun shell receiving chambers contains a chamber sleeve of a second material.

7. The cylinder of claim 6 wherein the first material is plastic and the second material is metal.

8. The cylinder of claim 1 wherein the plurality of shotgun shell receiving chambers consists of six shotgun shell receiving chambers equally spaced circumferentially about the rotational axis.

9. Portions of a shotgun comprising:

a cylinder body defining a rotational axis;

wherein the cylinder body has portions forming an opening centered about the rotational axis and has portions defining at least part of each of a plurality of shotgun shell receiving chambers which are parallel to and equally spaced from the rotational axis;

wherein the shotgun shell receiving chambers have first ends on a first side of the cylinder body arranged to receive shotgun shell bases, and wherein the receiving chambers have second ends on a second side of the cylinder body which are parallel to and opposite the first side, the receiving chamber second ends defining openings through which a shotgun round exits;

wherein a first direction along the rotational axis is defined from the first side to the second side;

a cylinder pin captured within the opening centered about the rotational axis so as to prevent rotation of the cylinder pin with respect to the cylinder body;

wherein the cylinder pin has a first end and a second end and extends from the first end to the second end in the first direction;

wherein the cylinder pin has portions forming a central axial opening which extends along the rotational axis;

a spring arranged to retract the cylinder pin into the cylinder body toward the second side of the cylinder body;

a trigger linkage mounted for movement in the opening centered about the rotational axis, the trigger linkage extending in the first direction for linking a trigger to a firing mechanism through the opening centered about the rotational axis; and wherein the cylinder pin second end has portions forming a toothed surface engagable to rotate the cylinder pin and the cylinder body.

10. The cylinder of claim 9 further comprising an extractor mounted in the opening centered about the rotational axis, the extractor having portions which extend into each of the plurality of shotgun shell receiving chambers so as to engage shotgun shells contained therein, the extractor biased by a spring to move rearwardly to effect shotgun shell casing extraction when the cylinder is removed from a receiver.

* * * * *